United States Patent [19]

Acquaro

[11] 3,945,078

[45] Mar. 23, 1976

[54] FLOOR SCRUBBER

[76] Inventor: Mario Acquaro, S. Antonio Abate, Pietravairano (Caserta), Italy

[22] Filed: Oct. 15, 1974

[21] Appl. No.: 514,892

[30] Foreign Application Priority Data

Oct. 16, 1973 Italy ..... 40435/73

[52] U.S. Cl. ..... 15/99

[51] Int. Cl.[2] ..... A47L 11/28

[58] Field of Search ..... 15/51, 99

[56] References Cited

UNITED STATES PATENTS

| | | | |
|---|---|---|---|
| 1,229,648 | 6/1917 | Olander | 15/51 |
| 1,554,070 | 9/1925 | Creasy | 15/99 |
| 1,941,690 | 1/1934 | Janchan | 15/51 |
| 2,153,686 | 4/1939 | Deegan, Sr. | 15/99 |
| 2,621,350 | 12/1952 | Bye | 15/51 |
| 2,953,798 | 9/1960 | Borie, Jr. | 15/99 |
| 3,030,914 | 4/1962 | Montgomery | 15/99 X |
| 3,052,905 | 9/1962 | McMillan et al. | 15/99 |

*Primary Examiner*—Edward L. Roberts

*Attorney, Agent, or Firm*—Ernest G. Montague; Karl F. Ross; Herbert Dubno

[57] ABSTRACT

A machine for scrubbing floors has a frame with an open bottom from which a lower run of an endless fabric belt projects downwardly, this belt passing around a large traction roller and several idler rollers journaled in the frame. One of the idler rollers is spring-loaded and mounted in a receptacle for water or other liquid into which the upper run of the belt dips from above before passing through a wringer constituted by a further roller and a coacting pressure roller. The traction roller is hollow and driven by a motor supported in its interior by an axle traversing one of the end faces of that roller.

9 Claims, 3 Drawing Figures

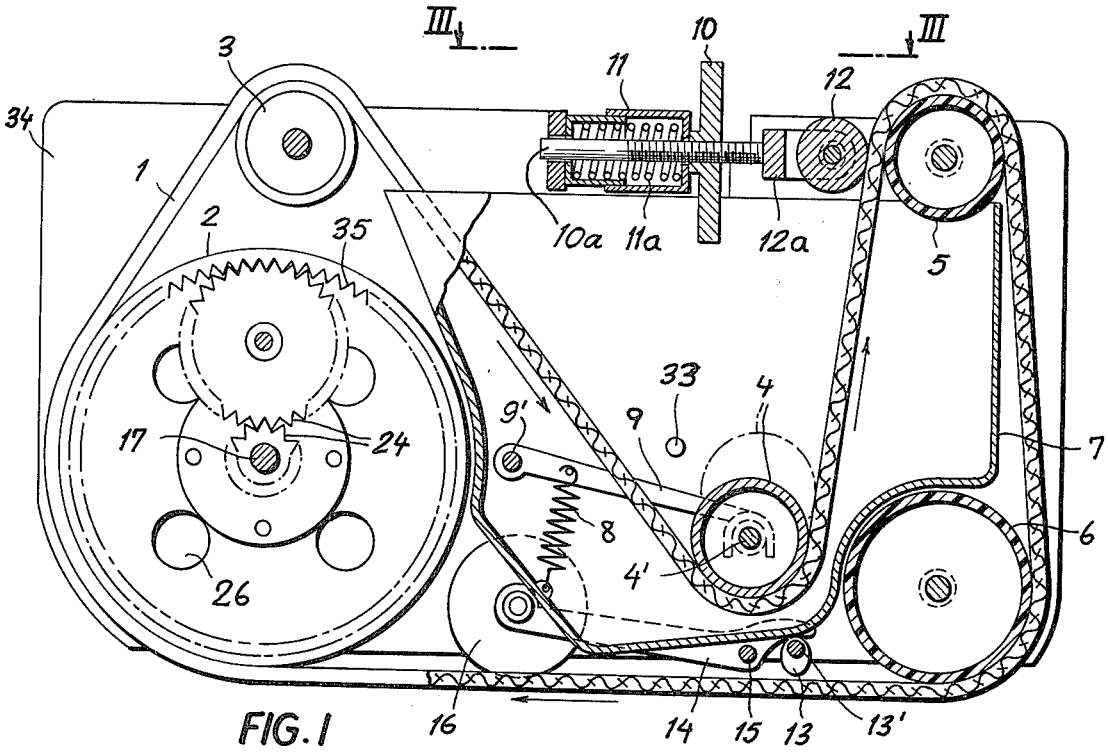
FIG. 1
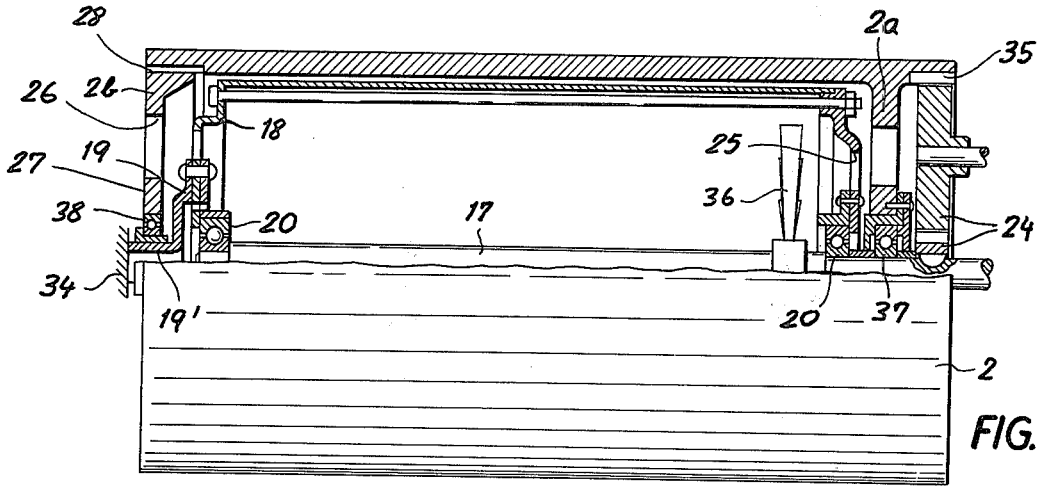
FIG. 2
FIG. 3
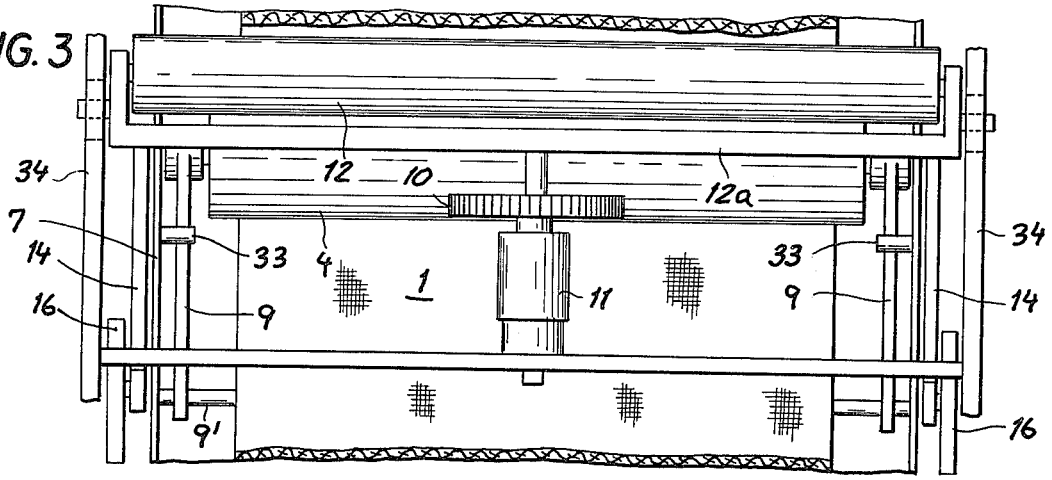

FLOOR SCRUBBER

FIELD OF THE INVENTION

My present invention relates to a machine for scrubbing floors, the term "scrubbing" including such operations as washing, wiping, shampooing, waxing, polishing and the like.

OBJECTS OF THE INVENTION

An important object of my present invention is to provide a machine of this character which can be readily adjusted for a variety of scrubbing operations, such as those mentioned above, and adapted to the treatment of different substrates including bare floors as well as rugs or carpets.

Another object is to provide a compact floor scrubber which is mobile and self-contained, except for possibly a power cable extending to a wall socket or other external current supply.

SUMMARY OF THE INVENTION

A floor scrubber according to my invention comprises an open-bottomed frame in which a set of guide rollers with horizontal axes are rotatably journaled, at least one of these rollers being positively coupled with an electric motor or other drive means for rotation thereby. An endless belt passes around these guide rollers, this belt having a lower run projecting downwardly from the open frame bottom to rub against an underlying floor surface while the frame is held stationary or guided in a desired direction against the reaction force exerted upon it by the belt. Major parts of the machine, including the guide rollers, may be made of plastic material.

According to another feature of my invention, an upwardly open receptacle for water or other treatment liquid is mounted in the frame and contains a further roller engaged by the upper run of the belt below the liquid level, the belt consisting of liquid-absorbing material so as to be thoroughly wetted by this immersion. A wringer above the receptacle, which is preferably adjustable, engages the belt downstream of the immersed roller which advantageously is provided with a spring-biased mounting for imparting proper tension to the belt.

Pursuant to a further feature of my invention, the traction roller is hollow to accommodate its drive motor in its interior so as to minimize the overall size of the assembly.

BRIEF DESCRIPTION OF THE DRAWING

The above and other features of my invention will now be described in detail with reference to the accompanying drawing in which:

FIG. 1 is a side-elevational view (with parts broken away) of a floor scrubber embodying my invention;

FIG. 2 is a front view, partly in section, of a traction roller forming part of the machine of FIG. 1; and FIG. 3 is a fragmentary top view as seen from the line III — III of FIG. 1.

SPECIFIC DESCRIPTION

As shown in the drawing, an endless belt 1 of absorbent but wear-resistant material (e.g. cotton fabric) travels around a set of guide rollers 2 – 6 with horizontal axes whose axles are supported in an open-bottomed frame comprising two sidewalls 34 interconnected by nonillustrated cross-bars.

Within the frame there is disposed a receptacle 7 filled with water or other liquid used for scrubbing a floor or washing a rug or carpet. Belt 1, moving clockwise, has an upper run passing above idler rollers 3, 5 and below idler roller 4, the latter being carried within receptacle 7 on a pair of arms 9 pivoted on an axle 9′ which spans the lateral walls of the receptacle. Two springs 8, anchored to arms 9, urge the roller 4 downwardly to tension the belt 1 as it dips into the liquid. The upward swing of arms 9 is limited by a stop 33 allowing a sufficient slackening of the belt to enable disengagement of the axle 4′ from its downwardly open journal bearings whereupon the belt can be slipped off the other rollers and removed around one of the sidewalls 34 for repair or replacement.

A cam 13, rotatable on a shaft 13′ by a crank not illustrated in the drawing, acts upon a pair of levers 14 fulcrumed on an axle 15 to raise or lower two wheels 16 with respect to the level of a lower run of belt 1, i.e. to a line tangent to the radius of rollers 2 and 6, in order to vary the pressure exerted by the belt 1 on the floor or to lift the belt completely off its supporting surface. Receptacle 7 is provided with a nonillustrated drain.

On emerging from receptacle 7, belt 1 passes through a wringer constituted by a pressure roller 12 coacting with guide roller 5 in an upper part of the frame. The pressure exerted on the belt 1 is controllable by a milled nut 10 on a bolt 10*a* rigid with a bracket 12*a* supporting the pressure roller 12. Nut 10 bears upon a telescoped cylinder 11 containing a compression spring 11*a*.

Roller 2, of larger diameter than the others, is hollow and serves as a traction roller driven by an electric motor whose casing 18 and shaft 17 are shown in FIG. 2, with omission of its field and armature windings for clarity's sake. This motor is disposed within traction roller 2 so that the machine can be made highly compact without impairing its performance.

Bearings 20 support the shaft 17 in motor casing 18 which is coaxial with roller 2, this casing having a flange 19 which is detachably secured to one of the frame members 34 and is traversed by electrical conductors leading to an external power source. Shaft 17 drives the roller 2 through a reduction gearing 24, this roller having two end walls 2*a*, 2*b* provided with perforations 26 through which air may circulate via similar perforations 25 in the end walls of motor casing 18. To facilitate such air circulation, a fan 36 is mounted on shaft 17 within the motor casing; it could, of course, also be located outside the casing. End wall 2*a* is supported in shaft 17 through a journal bearing 37 whereas end wall 2*b* rides on a trunnion 19′, formed by the stationary flange 19, with interposition of a similar journal bearing 38. This end wall 2*b* is removably fitted into the cylindrical roller body, with the aid of meshing serrations 28, to provide ready access to the motor for purposes of inspection and repair.

The position of idler rollers 3 and 6 at diagonally opposite corners of frame 34 is so chosen that the belt 1 envelops the traction roller 2 along an arc substantially greater than 90° which, with proper tensioning of the belt by roller 4, should suffice to insure frictional entrainment thereof. If necessary, however, supplemental drive means may be provided for one or more of the guide rollers 3, 5 and 6; rollers 2 acts as a flywheel.

Advantageously, pursuant to another feature of my invention, the journaling of tension roller 4 in its bearings is slightly eccentric so that the belt 1 is subjected to a certain amount of vibration as it passes around the roller; this has been schematically indicated by dot-dash lines in FIG. 1. The vibrations help dislodge excess liquid from the rising stretch of the belt on its way to the wringer 5, 12, thus allowing a more accurate control of the moisture content of the blet downstream of that wringer by means of pressure regulator 10, 11. In this way, the operation of the machine can be adapted to various kinds of substrates to be scrubbed, e.g. wood floors, rugs or carpets, and can also be modified for different types of operation such as the spreading of liquid wax on a floor and the subsequent polishing thereof with a nearly dry belt.

The frame 34 may be provided with one or more handles, not shown, to facilitate its manual displacement across a surface to be scrubbed and to allow the user to hold it in a desired position against dislodgement by the continuously driven belt 1.

Naturally, my invention is not limited to the specific construction shown and described, except as specified in the appended claims.

I claim:

1. A floor scrubber comprising:

a frame with an open bottom and two parallel sidewalls;

an upwardly open receptacle for a treatment liquid located between said sidewalls in said frame;

a set of guide rollers with horizontal axes journaled in said sidewalls;

an endless belt of liquid-absorbing material passing around said guide rollers, said belt having a lower run projecting downwardly from said open bottom and an upper run dipping into said receptacle;

a pair of arms mounted in said receptacle for swinging about a pivotal axis parallel to those of said guide rollers, said arms terminating in a pair of downwardly open journal bearings;

a further roller disposed in said receptacle above said upper run with an axle lodged in said journal bearings; and spring means engaging said arms for urging said further roller downwardly against said upper run to tension said belt, said arms being upwardly swingable against the force of said spring means to a sufficient extent to enable dislodgment of said axle from said journal bearings and withdrawal of said further roller from said receptacle to facilitate removal of said belt from said guide rollers around one of said sidewalls.

2. A floor scrubber as defined in claim 1, further comprising wringer means above said receptacle engaging said belt downstream of said further roller.

3. A floor scrubber as defined in claim 2 wherein said wringer means comprises a pressure roller and a coacting guide roller.

4. A floor scrubber as defined in claim 3 wherein said pressure roller is provided with adjustable biasing means urging same toward said coacting guide roller.

5. A floor scrubber as defined in claim 2 wherein said further roller is eccentrically mounted in said journal bearings for vibrating said belt on its way to said wringer means.

6. A floor scrubber as defined in claim 1 wherein said one of said guide rollers is hollow, said drive means comprising a motor mounted in the interior of said hollow roller.

7. A floor scrubber as defined in claim 8 wherein said motor has a drive shaft coaxial with said hollow roller, further comprising transmission means coupling said drive shaft with said hollow roller and fan means on said drive shaft for circulating air through said hollow roller, said motor and said transmission means.

8. A frame scrubber as defined in claim 11, further comprising retractable wheel means on said frame displaceable relatively thereto for lifting said lower run off a floor surface contacted by said wheel means.

9. A floor scrubber as defined in claim 1, further comprising stop means in said receptacle for limiting the upward swing of said arms.

* * * * *